US005611319A

United States Patent [19]

Machida

[11] Patent Number: 5,611,319

[45] Date of Patent: Mar. 18, 1997

[54] AIR FUEL RATIO CONTROL SYSTEM FOR ENGINE WITH FUEL VAPOR RECOVERY SYSTEM

[75] Inventor: Kenichi Machida, Isesaki, Japan

[73] Assignee: Unisia Jecs Corporation, Atsugi, Japan

[21] Appl. No.: 620,300

[22] Filed: Mar. 22, 1996

[30] Foreign Application Priority Data

Mar. 24, 1995 [JP] Japan ..... 7-66304

[51] Int. Cl.[6] ..... F02D 41/14

[52] U.S. Cl. ..... 123/680; 123/690; 123/698

[58] Field of Search ..... 123/680, 690, 123/698

[56] References Cited

U.S. PATENT DOCUMENTS 5,408,866 4/1995 Kawamura et al. ..... 73/40
5,411,007 5/1995 Narita ..... 123/690

FOREIGN PATENT DOCUMENTS 62-7962 1/1987 Japan .
6-159158 6/1994 Japan .

*Primary Examiner*—Andrew M. Dolinar
*Attorney, Agent, or Firm*—Foley & Lardner

[57] ABSTRACT

An air fuel ratio control system is so arranged to restrain a undesired variation of an air fuel ratio due to an on off control of a canister purge and thereby prevent deterioration of an exhaust performance. When a purge cut valve is closed to cut off the canister purge, the control system changes a feedback air fuel ratio corrective factor ALPHA like a step change to a predetermined initial value EVALP# to meet a leaning change of the air fuel ratio caused by the purge cut. When the purge cut valve is opened to resume the canister purge, the control system meets an enriching change of the air fuel ratio caused by restarting of the purge by producing a step change in the corrective factor ALPHA to an initial value EALPHA×KEVAL# determined in accordance with a value EALPHA of the corrective factor ALPHA obtained immediately before the cutoff (KEVAL# is a constant).

5 Claims, 5 Drawing Sheets

AIR FUEL RATIO CONTROL SYSTEM FOR ENGINE WITH FUEL VAPOR RECOVERY SYSTEM

BACKGROUND OF THE INVENTION

The present invention relates to an air fuel ratio control system for an engine equipped with a fuel vapor recovery system, and more specifically to an air fuel ratio control system designed to prevent degradation of the air fuel ratio control performance due to the fuel vapor recovery control.

There is known a system having a canister (adsorbing means) for adsorbing and trapping fuel evaporated in a fuel tank, a passage for purging and sucking the fuel vapor trapped in the canister by the aid of the intake vacuum and introducing the fuel vapor together with fresh air to an engine intake system. With these components, this system can prevent the fuel vapor from escaping from the fuel tank into the atmosphere. A Japanese Patent Provisional Publication No. 62-7962 discloses an fuel vapor adsorbing system of this kind.

If there is formed a crack in the piping for conveying the fuel vapor or if a flaw is developed in a sealed joint of pipes, the fuel vapor escapes through such a leak to the outside, and the system becomes deficient in controlling the evaporative emission.

Therefore, a Japanese Patent Provisional Publication No. 6-159158 proposes a leak diagnosis system for an evaporative emission control system. This diagnostic system has a drain cut valve for shutting off the supply of fresh air into the canister, and a purge cut valve disposed in a purge passage for communication between the canister and the engine intake system. By opening the purge cut valve while shutting off the supply of fresh air with the drain cut valve, the diagnostic system introduces the negative pressure into a line extending from the fuel tank through the canister to the engine, and detects a decreasing change of the pressure in the line caused by the opening of the purge cut valve. Thereafter, the diagnostic system detects an increasing change of the pressure in the line by closing the purge cut valve. From these pressure changes, this diagnostic system can diagnose a leak condition. (This Japanese Publication corresponds to a U.S. Pat. No. 5,408,866. The explanation and figures of this U.S. Patent about the leak diagnosis system is herein incorporated by reference.)

SUMMARY OF THE INVENTION

The on-off control of the canister purge in the above-mentioned leak diagnostic system, however, tends to cause an abrupt change in the air fuel ratio. A conventional feedback air fuel ratio control system often fails to follow up such an abrupt change immediately and allows an air fuel ratio deviation to deteriorate the exhaust performance.

A purge control valve for controlling an opening area of the purge passage can vary the purge flow gradually and thereby contain changes in the air fuel ratio within a range in which the feedback control system can follow.

The leak diagnosis, however, requires the on-off control of the purge cut valve to ensure the accuracy of the diagnosis in addition to the control valve. Therefore, the purge control valve and purge cut valve are arranged in series, and the diagnostic system performs the leak diagnostic operation by controlling the purge cut valve in the on-off manner while holding the control valve in the fully open state. When a request signal is produced to request a purge cutoff during such a diagnostic operation, the air fuel ratio can change so abruptly that the feedback air fuel control system cannot follow.

Therefore, it is an object of the present invention to provide an air fuel ratio control system for restraining air fuel ratio changes due to on-off purge control operations of a fuel vapor recovery system.

According to the present invention, an air fuel ratio control system has a fuel vapor recovery system which has an adsorbing means for adsorbing fuel vapor in a fuel tank and a purging means for purging and drawing the fuel vapor trapped in the adsorbing means to an engine intake system of an engine together with fresh air by using an intake negative pressure of the engine.

This air fuel control system further comprises a plurality of means as shown in FIG. 1.

A feedback air fuel ratio correcting means shown in FIG. 1 determines a feedback air fuel ratio corrective quantity to correct a fuel supply quantity to the engine so as to reduce a deviation of the air fuel ratio sensed by an air fuel ratio sensing means from a desired air fuel ratio.

A corrective quantity storing means is a means which, if a cutoff request to cut off the fuel vapor is generated during an operation for purging and drawing (sucking) the fuel vapor, stores the value of the feedback corrective quantity obtained immediately before the generation of the cutoff request.

A first initializing means functions to produce a step change in the feedback corrective quantity to a predetermined first initial value when the cutoff request is generated, and by so doing causes the feedback system to control the air fuel ratio by using the corrective quantity determined in accordance with the first initial value.

When the operation for purging and drawing the fuel vapor is resumed, a second initializing means shown in FIG. 1 produces a step change in the air fuel ratio corrective quantity to a second initial value determined in accordance with the feedback air fuel ratio corrective quantity stored in the corrective quantity storing means, and causing the air fuel ratio to be controlled in accordance with the feedback corrective quantity determined by the second initial value.

This air fuel control system changes the air fuel ratio correction quantity immediately to the predetermined first initial value on the occurrence of the cutoff request of the fuel vapor, and by so doing, causes the air fuel ratio correction quantity to be varied from this initial value in accordance with the sensed air fuel ratio.

The interruption of the purging and sucking operation of the fuel vapor tends to cause an abrupt change of the actual air fuel ratio in the leaning direction, and this change is so abrupt that the feedback air fuel ratio control system is unable to follow this change if arranged to start controlling the air fuel ratio from the level in the purging and sucking operation. Therefore, this air fuel ratio control system is arranged to prevent such an abrupt air fuel ratio change by producing the step change to the initial value preliminarily determined to suit the cut state.

The resumption of the purging and sucking operation of the fuel vapor tends to cause an abrupt change of the air fuel ratio in the enriching direction. Therefore, this air fuel ratio control system produces a step change to the second initial value to prevent such an abrupt enriching change in the air fuel ratio. In this case, the second initial value is determined in accordance with the feedback air fuel ratio correction quantity obtained immediately before the occurrence of the cutoff request, so as to change the feedback air fuel ratio correction quantity immediately to the level required in the purging and sucking operation.

The air fuel ratio control system may further comprises a means for producing the cutoff request when the engine comes into an engine idling condition. In this case, the purging and sucking operation is interrupted in the engine idling operation, so that the system can prevent the idling performance from being adversely affected by the purging and sucking operation.

There may be further provided, in a purge passage connecting the adsorbing means and the engine intake system, a cut valve for opening and closing the purge passage in a manner of on-off control and a control valve for regulating an open sectional area of the purge passage. The cut valve and the control valve are arranged in series in the purge passage, and the first and second initialing means are operated, respectively, by the opening operation and the closing operation of the cut valve in the control state in which the control valve is fully open.

In this case, the step changes of the air fuel ratio to the initial values are produced only when-the purge flow rate is changed by the maximum amount by the opening or closing operation of the cut valve in the fully open state of the control valve. When, on the other hand, the control valve decreases or increases the purge flow gradually, the feedback control system can adequately control the air fuel ratio in the normal manner.

The air fuel ratio control system may further comprise a fresh air shutting means for selectively shutting off the introduction of fresh air to the adsorbing means, a pressure sensing means for sensing a pressure in a fuel vapor treatment path (or fuel vapor recovery path) extending from the fuel tank through the adsorbing means to the engine intake system, and a leak diagnosing means diagnosing a leak condition in the fuel vapor treatment path in accordance with changes in the sensed pressure caused by the opening and closing operations of the cut valve in the fully open state of the control valve. The first and second initializing means are arranged to be operated when the cutoff request is generated during the opening control of the cut valve by the leak diagnosing means. The control system shuts off the introduction of the fresh air into the adsorbing means and holds the control valve in the fully open state. While this state is maintained, the control system controls the introduction of the engine negative pressure into the line by opening and closing the cut valve. By monitoring changes of the pressure during this, the control system diagnoses the leak condition. During this diagnostic control operation, the control system controls the cut valve in the on off control manner in the fully open state of the control valve. Therefore, the control system produces the step changes during the leak diagnostic operation to maintain the proper air fuel ratio control characteristic.

DETAILED DESCRIPTION OF THE INVENTION

Figure 2:
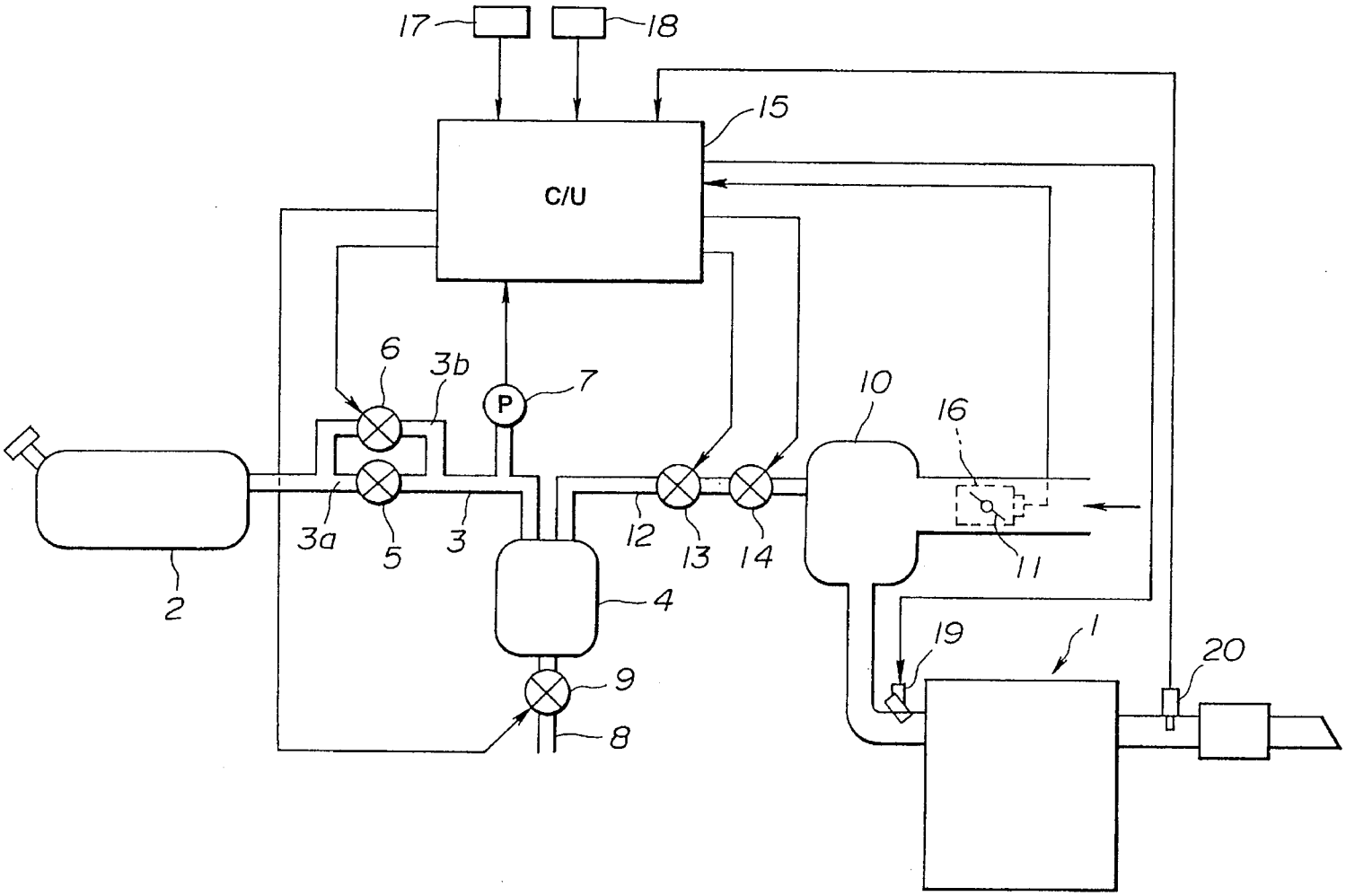
FIG. 2 is a schematic view of an air fuel ratio control system according to one embodiment of the present invention.

FIG. 2 shows an air fuel ratio control system according to one embodiment of the present invention.

A fuel vapor passage 3 shown in FIG. 2 has a first passage end connected to a fuel tank 2 for storing fuel for an engine 1, and a second passage end connected to a canister 4 (adsorbing means) for trapping and adsorbing fuel vapor temporarily.

The fuel vapor passage 3 has first and second branch passages 3*a* and 3*b* both extending from a first branch point to a second branch point. The fuel vapor passage 3 has a first confluence section extending from the fuel tank 2 to the first branch point, and a second confluence section extending from the second branch point to the canister 4. The first and second branch passages 3*a* and 3*b* diverge from each other at the first branch point, and meet again at the second branch point.

A mechanical check valve 5 is disposed in the first branch passage 3*a*. A electromagnetic bypass valve (or check valve bypassing valve) 6 is disposed in the second branch passage 3*b*. In this example, the pressure for opening the check valve 5 is set equal to a sum of the atmospheric pressure plus $\alpha$ mmHg. Therefore, the check valve 5 opens in a pressurized state equal to or higher than a predetermined pressure.

A pressure sensor 7 (pressure sensing means) shown in FIG. 2 is for sensing the pressure in the fuel vapor passage 3 (fuel vapor treatment or recovery path). The pressure sensor 7 is provided in the second confluence section of the fuel vapor passage 3 between the second branch point and the canister 4.

A fresh air passage (or atmosphere introduction passage) 8 is for introducing fresh air. The fresh air passage 8 is connected to the canister 4. An electromagnetic drain cut valve (fresh air cutting means) 9 for selectively shutting off the introduction of fresh air is disposed in the fresh air passage 8.

A purge passage 12 extends from the canister 4 to an intake collector section 10 of an intake manifold. The purge passage 12 carries the fuel vapor temporarily captured in the canister 4 to the intake collector section 10 which is located on the downstream side of a throttle valve 11.

Purge cut valve 13 and purge control valve 14 of an electromagnetic type are disposed in series in the purge passage 12. The purge cut valve 13 is an electromagnetic valve for opening and closing the purge passage in the manner of on-off control. The purge control valve 14 is a flow regulating valve (or flow control valve) for varying its opening degree to vary an opening area of the purge passage 12. For example, the control valve 14 is arranged to vary the flow continuously.

When the purge cut valve 13, the purge control valve 14 and the drain cut valve 9 are all in the open state, an engine intake negative pressure is introduced into the canister 4 through the purge passage 12, and accordingly the fresh air introduced into the canister 4 through the fresh air passage 8 and the fuel vapor purged from the canister 4 are sucked together into the intake collector section 10, and supplied to the engine 1 for combustion. When the purge cut valve 12 is in the open state, the purge control valve 14 can control the amount of purge air by varying its opening degree.

Figure 1:
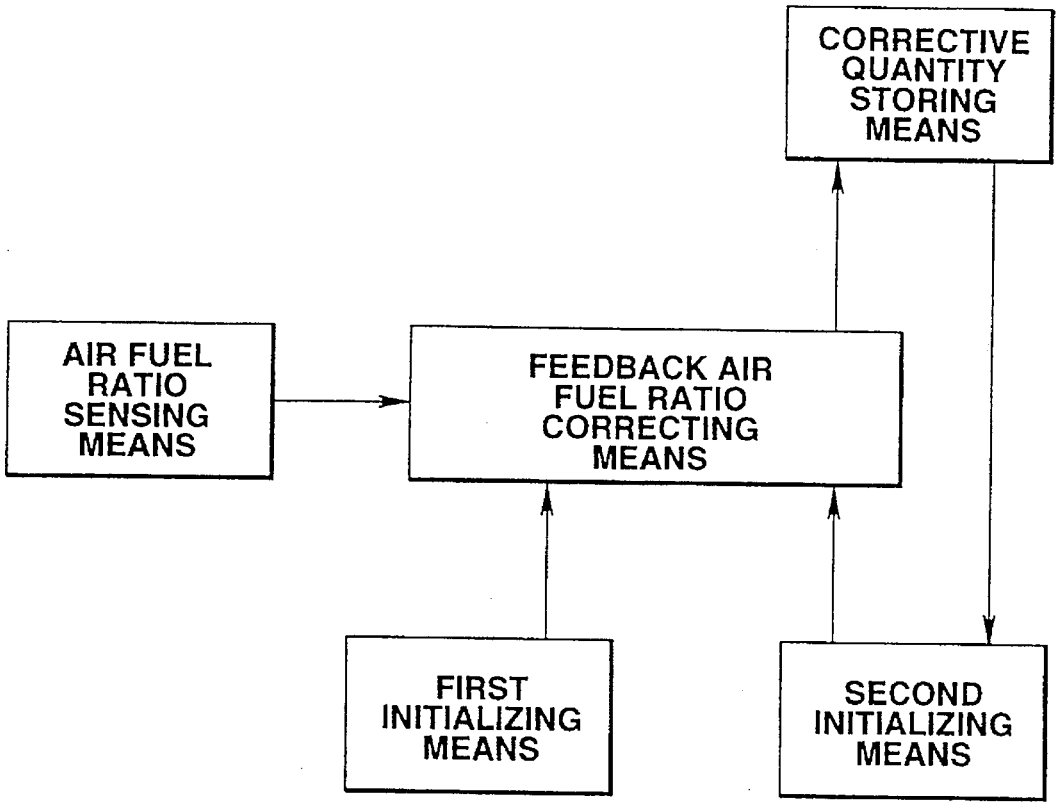
FIG. 1 is a block diagram showing an arrangement of various means used in the present invention, as an example.

An idle switch 16 shown in FIG. 1 in an on state when the throttle valve 11 of the engine 1 is in a fully closed position (idle position). An air flow meter 17 senses a intake air flow rate of the engine 1. A crank angle sensor 18 senses the crank angle of the engine 1.

A control unit 15 of this example has a microcomputer therein. The control unit 15 receives a pressure signal from the pressure sensor 7, an on-off signal from the idle switch 16, an intake air flow signal Q from the air flow meter 17, and a rotation signal from the crank angle sensor 18. In accordance with these signals, the control unit 15 controls the bypass valve 6, the drain cut valve 9, the purge cut valve 13 and the purge control valve 14. In particular, the control unit 15 opens and closes the valves in accordance with the signals from these sensing components, and performs a canister purge control as well as a leak diagnostic operation.

The control unit 15 controls the fuel injection quantity of at least one fuel injector 19 in the following manner.

The control unit 15 determines a basic fuel pulse width (or pulse duration) Tp in accordance with the intake air flow rate Q and the engine rotational speed Ne. Furthermore, by using a signal from an oxygen sensor (air fuel ratio sensing means) 20 for sensing the oxygen content in the exhaust gas mixture closely related to the air fuel ratio of the air fuel mixture, the control unit 15 determines a feedback air fuel ratio correction factor (air fuel ratio correction quantity) ALPHA according to a proportional plus integral control so as to reduce a deviation of the actual air fuel ratio to a desired air fuel ratio (air fuel ratio feedback correcting means). The feedback correction factor ALPHA is used for modifying the basic injection pulse width Tp. The control unit 15 then determines a final fuel injection pulse width Ti by multiplying the basic fuel injection pulse width Tp by the feedback air fuel ratio correction factor ALPHA (initial value=1.0). At a predetermined fuel injection timing, the control unit 15 delivers a injection pulse signal of the final injection pulse width Ti to the fuel injector 19.

Figure 3:
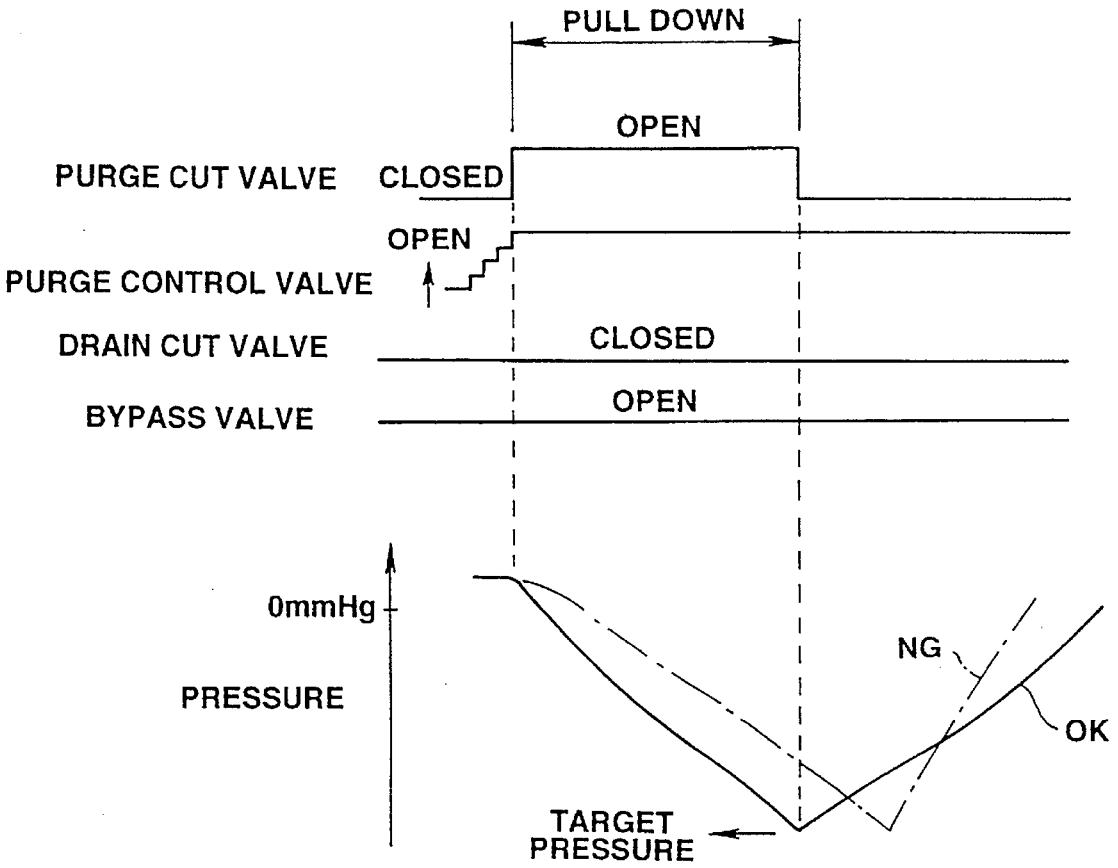
FIG. 3 is a time chart for illustrating a leak diagnostic operation in the air fuel ratio control system according to the embodiment of the present invention.

The control unit 15 performs the leak diagnostic operation (serving as a leak diagnosing means) as shown in a time chart of FIG. 3.

When a predetermined operating condition for diagnosis is reached, the control unit 15 controls the purge control valve. 14 to the fully open state while holding the drain cut valve 9 in the closed state, and changes the purge cut valve 13 from the closed state to the open state when the purge control valve 14 reaches the fully open state. Due to the opening operation of the purge cut valve 13, the negative pressure of a constant flow rate is introduced in the canister purge line (a pull down control state), and the control unit 15 measures a time elapses until the pressure sensed by the pressure sensor 7 reaches a target pressure because of this introduction of the negative pressure. Then, when the target pressure is reached, the control unit 15 shuts off the negative pressure introduction by closing the purge cut valve 13, and stores an increasing change of the canister purge line pressure. The control unit 15 estimates a leak hole diameter from the time required for the target pressure to be reached, and the time and pressure of the line pressure increase, and judges there exists a leakage when the leak hole diameter is equal to or greater than a predetermined value.

If, during the introducing operation of the negative pressure in the leak diagnostic control (during the pull down control, that is), the idle switch 16 is turned on and a request signal is produced to request the cutoff of the canister purge, the purge cut valve 13 is closed in response to this cutoff request signal. This operation causes an abrupt change of the purge air quantity like an on off system, resulting in a sharp change of the air fuel ratio. In this case, the feedback air fuel ratio control system is liable to fail in following up such a sharp change and cause deterioration of the exhaust performance. When, on the other hand, the system performs the leak diagnostic operation depending on the negative pressure introducing state again after the idle switch 16 returns to the off state and the cutoff request is canceled, the system controls the purge cut valve to the open state while holding the purge control valve 14 fully open. In this case, too, the air fuel ratio tends to change so sharply that the feed back air fuel control system cannot follow up and the exhaust characteristic becomes worse.

Figure 4:
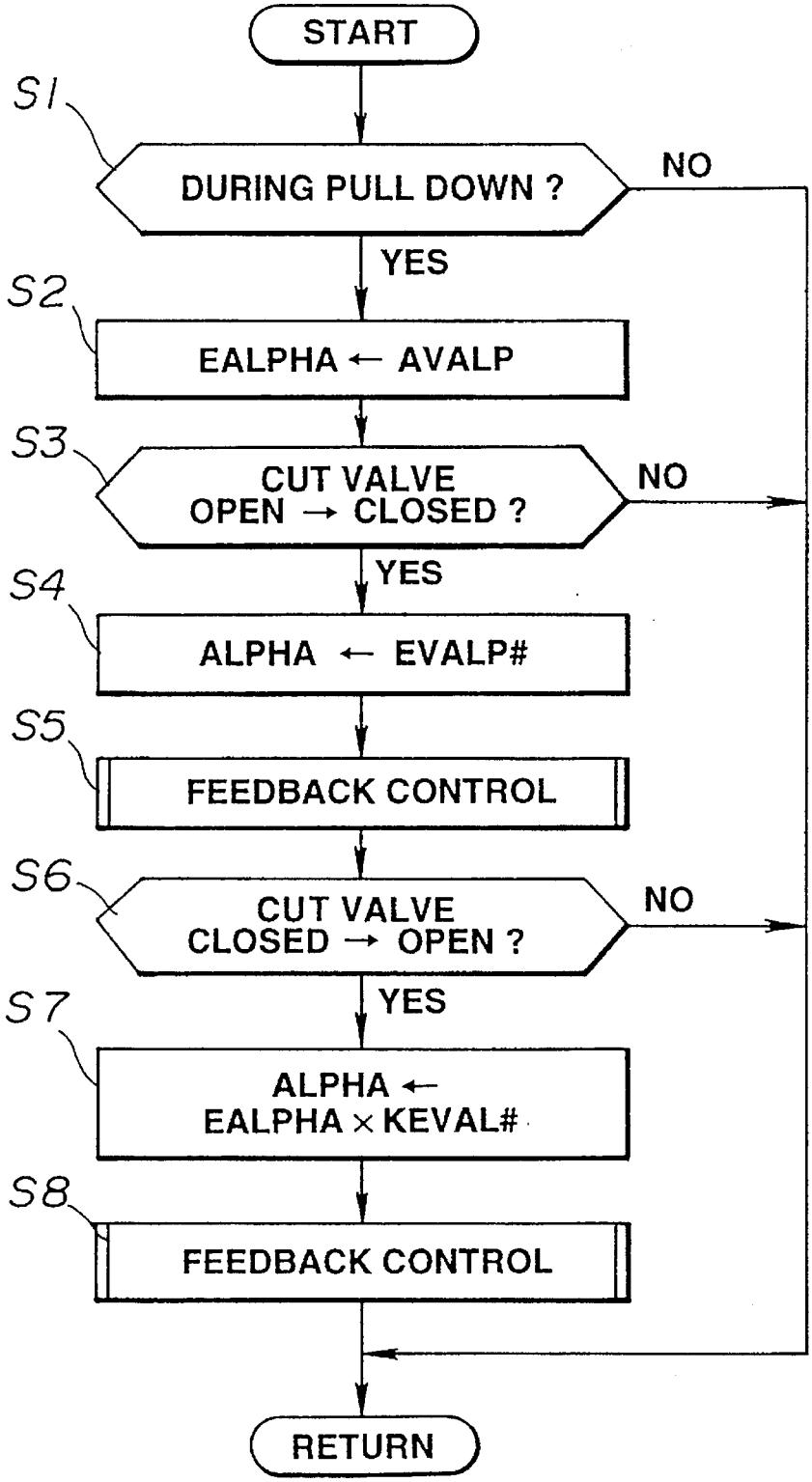
FIG. 4 is a flow chart showing a feedback air fuel ratio control procedure during the leak diagnostic operation in the control system according to the embodiment of the present invention.
Figure 5:
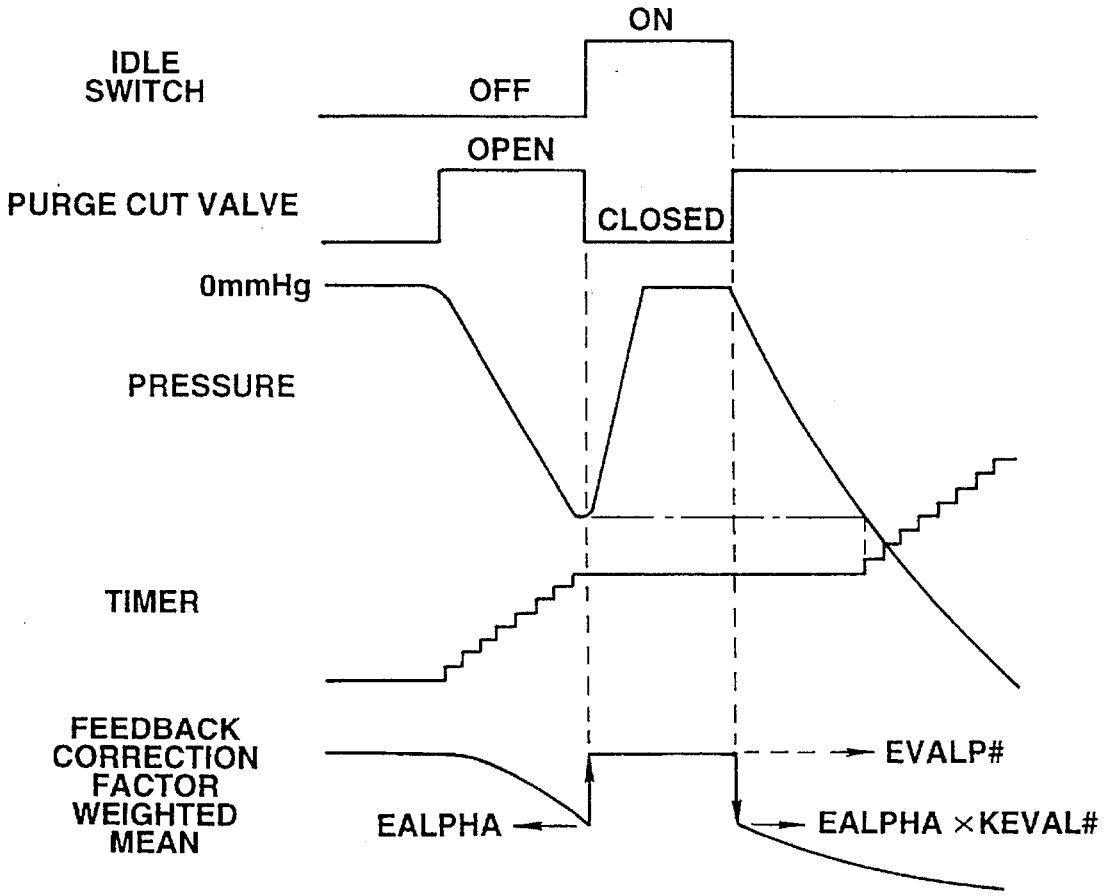
FIG. 5 is a time chart for illustrating the air fuel ratio control during the leak diagnostic operation according to the embodiment of the present invention.

Therefore, the control system according to this embodiment of the invention performs the feedback air fuel ratio control during the pull down control in the leak diagnosis as shown in a flowchart of FIG. 4, and a time chart of FIG. 5. In this example, the control unit 15 is programmed so as to serve as a correction quantity storing means, a first initializing means for initializing at the time of generation of the cutoff request, and a second initializing means for initializing at the time of resumption.

At a step S1 of FIG. 4, the control unit 15 determines whether the pull down control is in operation, or not. When the pull down control is in progress, the control unit 15 proceeds to a step S2, at which the control unit 15 stores a weighted mean AVALP of the feedback correction factor ALPHA as a sequential initial value EALPHA.

At a step S3, the control unit 15 determines whether or not the purge cut valve 13 is controlled to the closed state in response to the purge cut request generated to maintain the operating stability at idle by a turn-on of the idle switch 16. When the purge cut valve 13 is closed due to the generation of the cutoff request during the pull down control, the control unit 15 proceeds to a step S4, and sets the feedback corrective factor ALPHA equal to a predetermined initial value EVALP#. By so doing, the control unit 15 produces a step change from the then-existing value of the corrective factor ALPHA to the predetermined initial value EVALP#. At a next step S5, the control unit 15 performs the proportional plus integral control of the corrective factor ALPHA from the initial value EVALP#.

The above-mentioned corrective factor ALPHA is controlled at a level smaller than the initial value of 1.0 to cancel enrichment of the air fuel ratio due to the supply of the purge air through the opened purge cut valve 13. Accordingly, the above-mentioned initial value EVALP# is preferably set equal to 1.0, that is the initial value of the feedback corrective factor ALPHA.

Thus, the control system can cause the step change of the corrective factor ALPHA in the enriching direction in compensation for an abrupt change of the air fuel ratio in the leaning direction due to the closure (purge cut) of the purge cut valve 13. Therefore, the feedback air fuel ratio control system is faithful to the actual change of the air fuel ratio and capable of preventing an undesired variation of the air fuel ratio.

At a step S6, the control unit 15 determines whether the purge cut valve 13 is controlled to the open sate in response to a turn-off of the idle switch 16 and cancellation of the purge cutoff request.

When the purge cut valve 13 is opened, the control unit 15 proceeds to a step S7. At the step S7, the control unit 15 multiplies the initial value EALPHA saved as the weighted mean AVALP of the corrective factor ALPHA immediately before the generation of the purge cutoff request, by a predetermined value KEVAL# (fixed value), and sets ALPHA equal to the resulting product (EALPHA× KEVAL#). By this operation, the control system causes a step change of the corrective factor ALPHA from the then-existing value of the corrective factor ALPHA to the product EALPHA×KEVAL#. At a next step S8, the control unit 15 performs the proportional plus integral control of the corrective factor ALPHA from the above-mentioned level of EALPHA×KEVAL#. Preferably, the predetermined value KEVAL# is set at the level of 80%, for example.

With the above mentioned step change to the level determined in accordance with the corrective factor ALPHA in the state in which the purge cut valve 13 is opened and the purge air is supplied to the engine, the control system can vary the corrective factor ALPHA responsively toward the required level in correspondence to an enriching change of the air fuel ratio due to restarting of the supply of the purge air, and prevent an undesired variation of the air fuel ratio.

Thus, this control system can perform the on-off control of the purge cut valve 13, maintaining the fully open state of the purge control valve 14, in response to the purge cutoff request during the pull down control, without causing a large air fuel ratio deviation and deterioration of the exhaust emission.

In this example, as shown in FIG. 5, if the cutoff request occurs during the pull down control, the purge cut valve 13 is closed in response to the request. When the purge cutoff request disappears, the purge cut valve 13 is opened again, and the pull down control is resumed to continue the leak diagnosis. Therefore, the timer for measuring the time until the target pressure is reached is held from the time of occurrence of the cutoff request until the pressure is lowered to the level of the time of occurrence of the cutoff request by resumption of the pull down control. When the pressure becomes equal to or lower than the pressure at the time of occurrence of the cutoff request, the count-up of the timer is restarted.

In the illustrated example, the purge control valve 14 and the purge cut valve 13 are arranged in series in the purge passage 12, and the purge cut valve 13 is controlled between the open and closed states in the fully open state of the control valve 14 during the leak diagnosis. However, the present invention is not limited to the above-mentioned valve arrangement, or to the control during the leak diagnosis. For example, a system arranged to control the supply of the purge air only with the purge cut valve may be arranged to carry out the above-mentioned step changes of the correction factor ALPHA in accordance with the opening and closing operations of the purge cut valve during the leak diagnostic control or during the normal purge control.

What is claimed is:

1. An air fuel ratio control system comprising:

a fuel vapor recovery system comprising an adsorbing means for adsorbing fuel vapor in a fuel tank and a purging means for purging and sucking the fuel vapor from the adsorbing means into an engine intake system of an engine together with fresh air by using an intake negative pressure of the engine;

an air fuel ratio sensing means for sensing an air fuel ratio of an intake air fuel mixture for the engine;

a feedback air fuel ratio correcting means for determining a feedback air fuel ratio corrective quantity to correct a fuel supply quantity to the engine so as to reduce a deviation of the air fuel ratio sensed by the air fuel ratio sensing means from a desired air fuel ratio;

a corrective quantity storing means for storing the feedback corrective quantity, said storing means including a means which, if a cutoff request to cut off the fuel vapor is generated during an operation for purging and sucking the fuel vapor, stores the feedback corrective quantity immediately before the generation of the cutoff request;

a first initializing means for producing a step change of the feedback corrective quantity to a predetermined first initial value when the cutoff request is generated; and a second initializing means for producing a step change of the feedback corrective quantity to a second initial value when the operation for purging and sucking the fuel vapor is resumed, said second initial value being determined in accordance with the feedback air fuel ratio corrective quantity stored in the corrective quantity storing means.

2. An air fuel ratio control system according to claim 1 wherein said control system further comprises a means for producing the cutoff request in an engine idling state.

3. An air fuel ratio control system according to claim 2 wherein said purging means comprises a purge passage connecting said adsorbing means with said engine intake system, a purge cut valve for opening and closing said purge passage in a manner of on-off control, a purge control valve for varying an opening area of said purge passage; said cut valve and control valve are arranged in series in said purge passage; said fuel vapor recovery system is arranged to open and close said cut valve in response to the cutoff request; and said first and second initializing means are operated, respectively, in accordance with opening and closing operations of said cut valve in a fully open state of said control valve.

4. An air fuel ratio control system according to claim 3 wherein said control system further comprises a fresh air shutting means for selectively shutting off introduction of fresh air to said adsorbing means; a pressure sensing means for sensing a pressure in a fuel vapor treatment path extending from said fuel tank through said adsorbing means to said engine intake system; a leak diagnosing means for diagnosing a leak condition in said fuel vapor treatment path in accordance with a change in the pressure sensed by said pressure sensing means due to opening and closing operations of said cut valve in a state in which said control valve is fully open; and a means for operating said first and second initializing means when said cutoff request is generated during an open control of said cut valve by said leak diagnosing means.

5. An air fuel ratio control system according to claim 1 wherein said purging means comprises a purge passage connecting said adsorbing means with said engine intake system, a purge cut valve for opening and closing said purge passage in a manner of on-off control, a purge control valve for varying an opening area of said purge passage; said cut valve and control valve are arranged in series in said purge passage; said fuel vapor recovery system is arranged to open and close said cut valve in response to the cutoff request; and said first and second initializing means are operated, respectively, in accordance with opening and closing operations of said cut valve in a fully open state of said control valve.

* * * * *